US009981802B2

(12) United States Patent
Reeb et al.

(10) Patent No.: US 9,981,802 B2
(45) Date of Patent: May 29, 2018

(54) LOCKING DEVICE FOR WASTE CONTAINER

(71) Applicant: SERIO-US INDUSTRIES, INC., Baltimore, MD (US)

(72) Inventors: David L. Reeb, Sykesville, MD (US); James L. Martin, II, Gambrills, MD (US)

(73) Assignee: Serio-Us Industries, Inc., Baltimore, MD (US)

( * ) Notice: Subject to any disclaimer, the term of this patent is extended or adjusted under 35 U.S.C. 154(b) by 189 days.

(21) Appl. No.: 15/233,599

(22) Filed: Aug. 10, 2016

(65) Prior Publication Data

US 2017/0043950 A1 Feb. 16, 2017

Related U.S. Application Data

(60) Provisional application No. 62/203,163, filed on Aug. 10, 2015.

(51) Int. Cl.

| | |
|---|---|
| ***B65D 55/02*** | (2006.01) |
| ***B65D 43/22*** | (2006.01) |
| ***B65F 1/16*** | (2006.01) |
| ***E05B 65/52*** | (2006.01) |
| ***E05B 17/20*** | (2006.01) |
| ***E05B 65/00*** | (2006.01) |
| ***E05C 3/06*** | (2006.01) |
| ***E05C 3/16*** | (2006.01) |

(52) U.S. Cl.

CPC ..... *B65F 1/1615* (2013.01); *B65F 1/1646* (2013.01); *E05B 17/2011* (2013.01); *E05B 65/006* (2013.01); *E05B 65/5292* (2013.01); *E05C 3/06* (2013.01); *E05C 3/16* (2013.01); *Y10T 292/1071* (2015.04)

(58) Field of Classification Search

CPC ..... E05B 15/0093; E05B 17/2011; E05B 47/0038; E05B 47/0607; E05B 65/006; E05B 65/5292; Y10T 292/1071

USPC ..... 220/212.5, 820, 835, 324, 908, 909; 292/183, 184, 192, 130, 230, 231, 236; 269/48.2, 48.3; 411/344

See application file for complete search history.

(56) References Cited

U.S. PATENT DOCUMENTS 3,912,314 A * 10/1975 Sompayrac ..... E05C 19/00 292/262
4,086,014 A * 4/1978 Jalaguier ..... F16B 21/125 24/453

(Continued)

FOREIGN PATENT DOCUMENTS

| | | |
|---|---|---|
| EP | 0509932 A1 | 10/1992 |
| FR | 2851783 A1 | 9/2004 |

OTHER PUBLICATIONS

ISR for corresponding PCT/US2016/046393 dated Oct. 24, 2016.

*Primary Examiner* — J. Gregory Pickett
*Assistant Examiner* — Gideon Weinerth
(74) *Attorney, Agent, or Firm* — Berenato & White, LLC

(57) ABSTRACT

The present invention generally relates to a rocking device for waste containers, particularly residential or commercial waste containers. In particular, the invention provides a waste container locking device which keeps the container closed when a sudden jerk or jarring, such as by ground impact, is applied on the container, so that the container does not open when it is accidentally knocked over, but may be opened when tipped during dumping.

29 Claims, 7 Drawing Sheets

(56) References Cited

U.S. PATENT DOCUMENTS 4,822,226 A * 4/1989 Kennedy ..... F16B 13/0808 411/340
4,997,327 A * 3/1991 Cira ..... F16B 13/0808 411/340
5,224,744 A 7/1993 Michelutti
6,029,709 A * 2/2000 Burgess ..... F16L 55/11 138/89
6,193,261 B1 * 2/2001 Hahka ..... B60D 1/02 24/453
6,290,093 B1 * 9/2001 Obriot ..... B65F 1/1615 220/324
9,115,744 B1 * 8/2015 Bulow ..... F16B 39/00
2003/0189340 A1 * 10/2003 Kitzis ..... B65F 1/1615 292/145
2006/0150696 A1 7/2006 Eychenne
2008/0023967 A1 * 1/2008 King ..... E05B 77/06 292/64
2008/0129057 A1 * 6/2008 Talbot ..... E05C 19/02 292/99
2009/0091141 A1 * 4/2009 Kreitzer ..... B65F 1/1615 292/130
2009/0218829 A1 * 9/2009 Stephens ..... B65F 1/1615 292/233
2010/0314404 A1 * 12/2010 Baltz ..... B65F 1/1615 220/834
2011/0049151 A1 * 3/2011 Raghunathan ..... B65F 1/1468 220/263
2012/0103034 A1 * 5/2012 Shartel ..... E05B 13/101 70/352
2013/0093196 A1 * 4/2013 Beer ..... E05C 3/008 292/130
2014/0020436 A1 * 1/2014 Matuschek ..... E05B 65/52 70/158
2014/0027454 A1 * 1/2014 Banik ..... B65F 1/16 220/212.5
2014/0208813 A1 * 7/2014 Reeb ..... B65F 1/1615 70/277
2014/0238990 A1 * 8/2014 Banik ..... B65F 1/1615 220/324
2015/0035288 A1 * 2/2015 Fink ..... E05B 63/24 292/2
2015/0159404 A1 6/2015 Treadwell
2016/0159569 A1 * 6/2016 Reeb ..... B65F 1/1615 220/315
2016/0159570 A1 * 6/2016 Reeb ..... B65F 1/1615 220/324
2017/0043950 A1 * 2/2017 Reeb ..... B65F 1/1615
2017/0166397 A1 * 6/2017 Reeb ..... B65F 1/1615
2017/0320665 A1 * 11/2017 Reeb ..... B65F 1/1615
2017/0320666 A1 * 11/2017 Reeb ..... B65F 1/1615
2018/0044941 A1 * 2/2018 Fink ..... E05B 15/0093

* cited by examiner

LOCKING DEVICE FOR WASTE CONTAINER

CROSS-REFERENCE TO RELATED APPLICATIONS AND CLAIM TO PRIORITY

This application claims the priority of U.S. Provisional Patent Application No. 62/203,163, filed Aug. 10, 2015, the disclosure of which is incorporated herein by reference.

FIELD OF THE INVENTION

The present invention generally relates to locking devices for waste containers, particularly residential or commercial waste containers. In particular, the invention relates to a waste container locking device which keeps the container closed when a sudden jerk or jarring, such as ground impact, is applied on the container and allows the container to be opened during the dumping or tipping process.

BACKGROUND

As is well known, residential or commercial waste containers, for use in residential or commercial applications, typically include a base structure covered by a lid. These containers usually contain a block-shaped container with a hinged lid attached to one side thereof. The containers may be emptied by an automated lifting device on certain waste removal vehicles, which tilts the waste containers for emptying the contents of the waste containers. The containers are generally lifted by the lifting mechanism and pivoted in some fashion so that the hinged top of the container opens and the trash contained therein is emptied into the vehicle. The container is then returned to a position on the ground, and the hinged lid closes the top of the container.

The waste containers may be available for purchase by home owners from various home improvement or department stores. When the container is in an upright position, the lid is closed and prevents animals from accessing the waste within the container. However, when the container is tipped over on its side, e.g. by animals or by strong wind, the lid may open, spilling the contents of the container or allowing animals to access the interior of the container.

Locks may be provided to prevent the lid from opening when the waste container is knocked over on its side or to prevent unwanted access to the container. However, these locks may prevent the automated lifting device on the trash removal vehicle from being able to empty the container, or require the operator to manually unlock the waste container before placing it on the automated lifting device.

Therefore, there remains a need for a locking device that prevents the unintended opening of the waste container, such as by an accidental knockdown, but does not require manual unlocking when being tilted over, e.g., by a lifting mechanism.

SUMMARY OF THE INVENTION

The present invention provides a locking device for a waste container that keeps the lid of the container closed when the container is knocked over on its side, with a sudden jerking or jarring motion, such as by impact with the ground, to prevent spillage of its contents. The locking device, however, allows the lid to open when the waste container is tipped over by a dumping operation.

An aspect of the present invention provides a locking device that is designed to be mounted in the lid of the waste container. The locking device contains a hook, a locking member, and an actuating mechanism. The locking member is attached to a wall of the waste container and is in a lockable relationship with the hook which is, directly or indirectly, attached to the lid of the waste container. The latching of the hook to a locking member keeps the lid in a closed position. The actuating mechanism can be placed in a raised position or a fully lowered position. In the raised position, the actuating mechanism unlatches the hook from the locking member to allow the lid to be opened. In a fully lowered position, the actuating mechanism allows the hook to latch to the locking member. In the event that the locking device falls on its side and impacts the ground, a detent mechanism prevents the actuating mechanism from being placed in a raised position, thus preventing unlatching of the hook from the locking member.

Another aspect of the present invention provides a waste container having the locking device mounted therein, preferably in the lid of the container. The lid contains a cutout through which the locking device is mounted.

Methods for making the different aspects of the present invention are also provided.

Other aspects of the invention, including apparatus, devices, kits, processes, and the like which constitute part of the invention, will become more apparent upon reading the following detailed description of the exemplary embodiments.

BRIEF DESCRIPTION OF THE DRAWINGS

The foregoing background and summary, as well as the following detailed description of the drawings, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION

Figure 1:
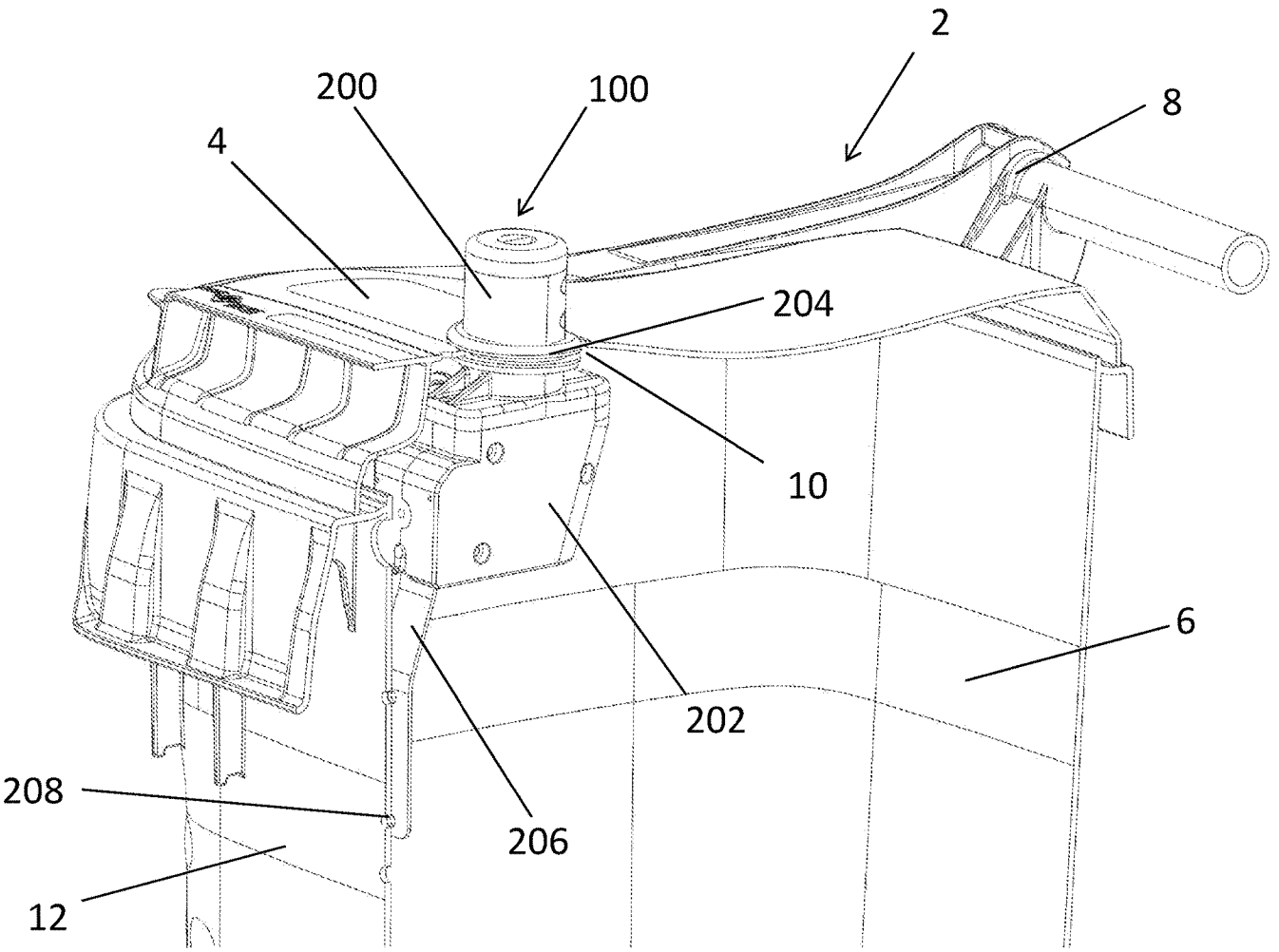
FIG. 1 shows a fragmentary cut away view of a waste container having the locking device of the present invention mounted thereon.

The exemplary embodiment of the present invention will now be described with the reference to accompanying drawings. The following description of the preferred embodiment is merely exemplary in nature and is in no way intended to limit the invention, its application, or uses.

For purposes of the following description, certain terminology is used in the following description for convenience only and is not limiting. The characterizations of various components and orientations described herein as being "vertical", "horizontal", "upright", "right", "left", "side", "top", "bottom", or the like designate directions in the drawings to which reference is made and are relative characterizations only based upon the particular position or orientation of a given component as illustrated. These terms shall not be regarded as limiting the invention. The words "downward" and "upward" refer to position in a vertical direction relative to a geometric center of the apparatus of the present invention and designated parts thereof. The terminology includes the words above specifically mentioned, derivatives thereof and words of similar import. Additionally, the word "a" as used in the claims means "at least one."

FIG. 1 illustrates a waste container 2, such as a trash container typically used by home owners or businesses to deposit, retain, or store trash awaiting pick-up by a trash removal vehicle. The container 2 may be tilted or otherwise pivoted from an upright storage position (as shown in FIG. 1) to a tilted or dumping position to empty its contents.

The container 2 has at least one lid 4 on top of a main box 6. Box 6 defines an interior volume for holding waste. The lid 4 is mounted on a lid hinge 8, typically at the rear, of the container 2 so that when an upward force is applied to the lid 4, it opens by pivoting on the lid hinge 8. A locking device 100 is mounted in a cutout 10 in the lid 4. In an exemplary embodiment, the mounting is such that a part of the locking device 100 protrudes above the lid 4 and thus outside of container 2, as best illustrated in FIG. 1. The locking device 100 is preferably positioned towards the front of the lid 4 for reasons to be apparent below.

Figure 2:
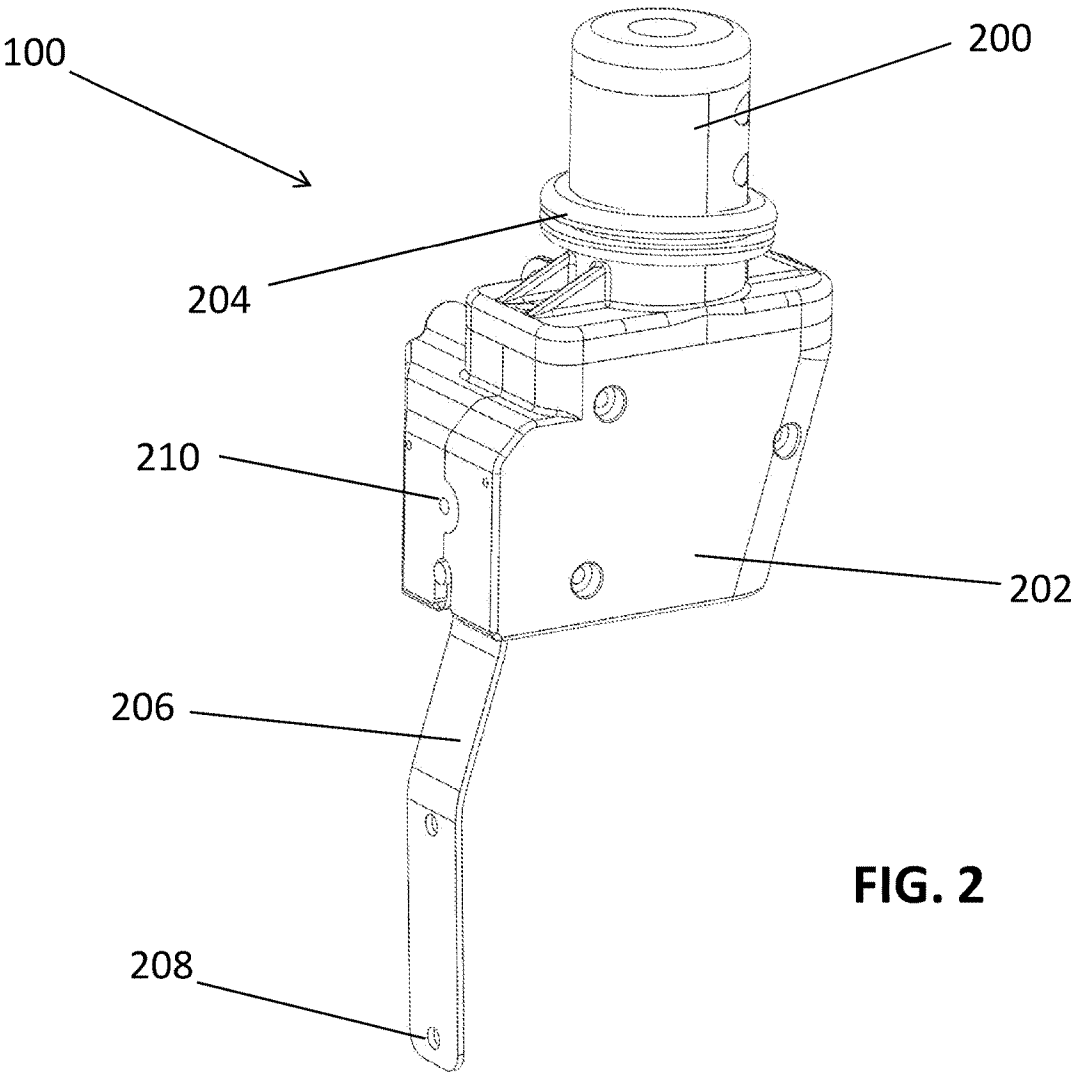
FIG. 2 shows a perspective view of the locking device of the present invention having the bottom cover attached.

Referring to FIGS. 1-2, the locking device 100 contains an housing 200 and an optional bottom cover 202 extending below the housing 200. The bottom cover 202 may be made of two halves that are attached together by fasteners, e.g. screws, to protect its content.

In an exemplary embodiment, as best shown in FIG. 1, the housing 200, a portion of which is exposed outside of the waste container 2, may be retained in the cutout 10 of the lid 4 by a collar 204. The collar 204 may be a ring, preferably made of an elastomer, having a channel around its outer circumference. The cutout 10 in the lid 4 fits into the channel; and the housing 200 is held in place by the friction between the inner diameter of the collar 204 and the outer surface of the housing 200.

A locking member 206, as best shown in FIG. 2, may protrude through an opening at the bottom of the bottom cover 202. The locking member 206 preferably has a flat portion that is fastened to a wall 12, preferably the from wall, of the main box 6, e.g. by screws or nuts/bolts, through at least one hole 208 (best shown in FIG. 1). When installed on the wall 12 of the waste container 2, the flat portion of the locking member 206 lays flat against the surface of the wall 12. At a top end closest to the lid 4, the locking member 206 contains a locking protrusion 302 (best shown in FIGS. 3-4) that is configured to interlock with a hook 300. Although the drawings illustrate that the hook 300 interlocks with the locking protrusion 302, one skilled in the art would appreciate that other locking mechanisms on the locking member 206 may be used to interlock with the hook 300 to produce similar results.

Figure 3:
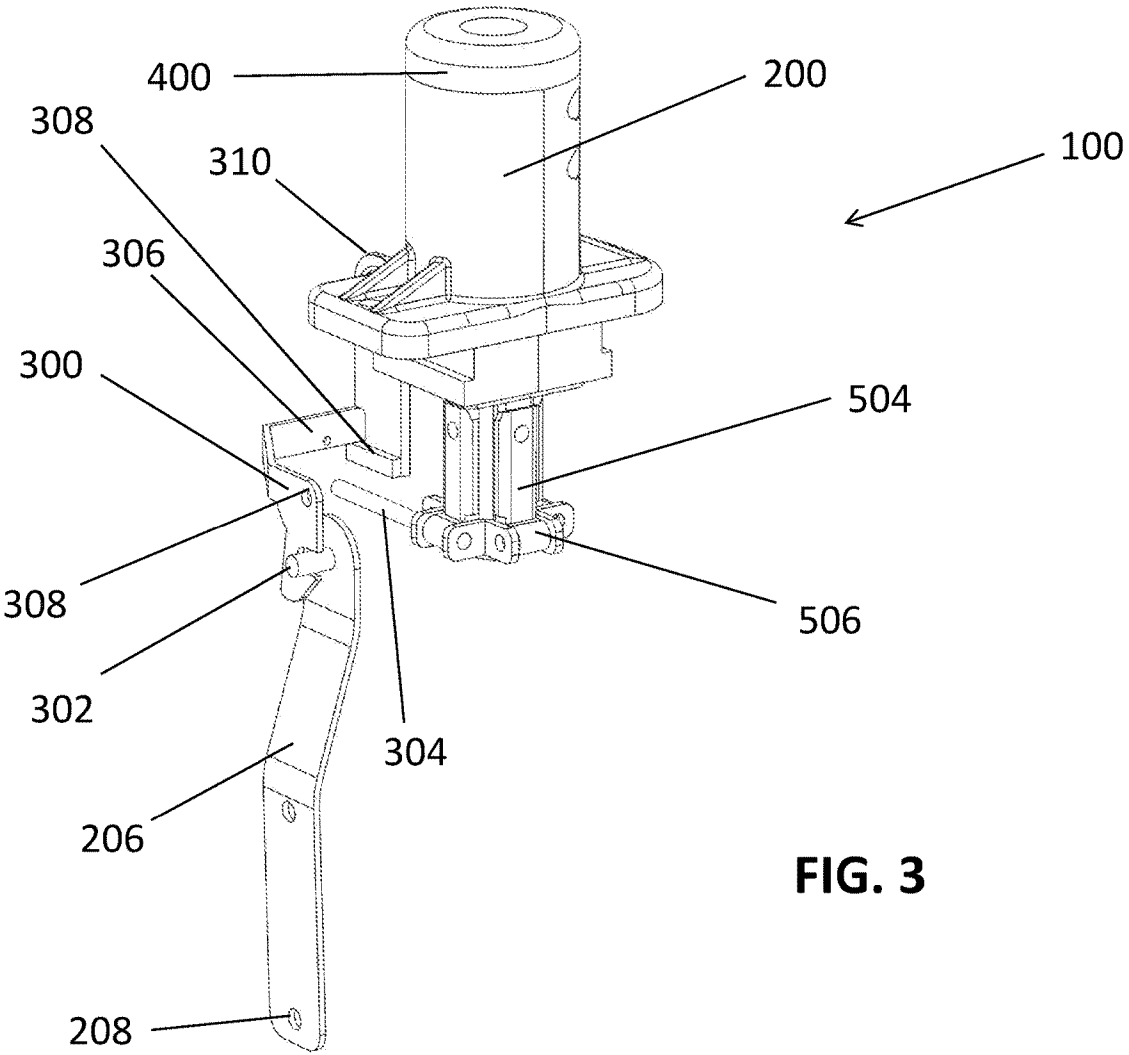
FIG. 3 shows a perspective view of the locking, device of the present invention having the bottom cover removed.
Figure 4:
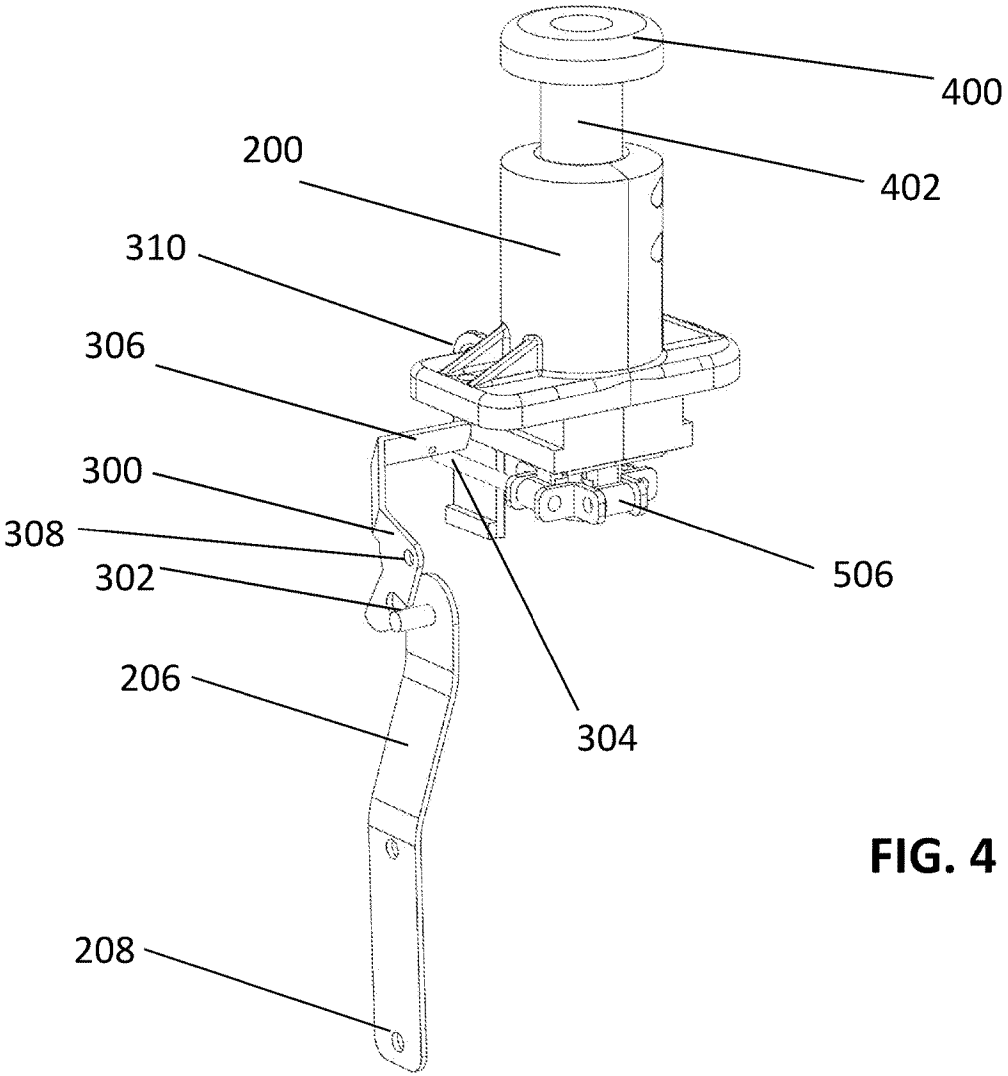
FIG. 4 shows a perspective view of the locking device of the present invention with the handle lifted away from the housing.

The hook 300 is attached, directly or indirectly, to the lid 4, and may be placed where convenient for operation of the locking device 100. As illustrated in the drawings, the hook 300 may be attached to the bottom cover 202 at hole 210, e.g. by a nut/bolt placed through a hole 308 on the hook and a hole 210 on the bottom cover 202. However, if the cover 202 is not present, the hook 300 may be attached directly to the lid 4 of the waste container 2 or to the housing 200 by means apparent to a skilled person upon reading the present disclosure. As best shown in FIGS. 3-4, when the waste container 2 is in its upright position and the lid 4 is closed, the hook 300, by gravity, engages the locking protrusion 302 to lock the lid 4 in place. Alternatively, the hook may be biased, e.g. by a spring, in a direction for locking engagement with the locking protrusion 302. As best shown in FIG. 3, the hook 300 also contains a deflecting arm 306 which is preferably bent at approximately perpendicular to the main body of the hook 300 and pointing towards the housing 200. When hook 300 engages the locking protrusion 302, the deflecting arm 306 locates just above a ledge 308 of a safety release 310. In an exemplary embodiment, the hook 300 and the portion of the locking member 206 that contains the locking protrusion 302, all may be contained within the bottom cover 202.

Figure 7:
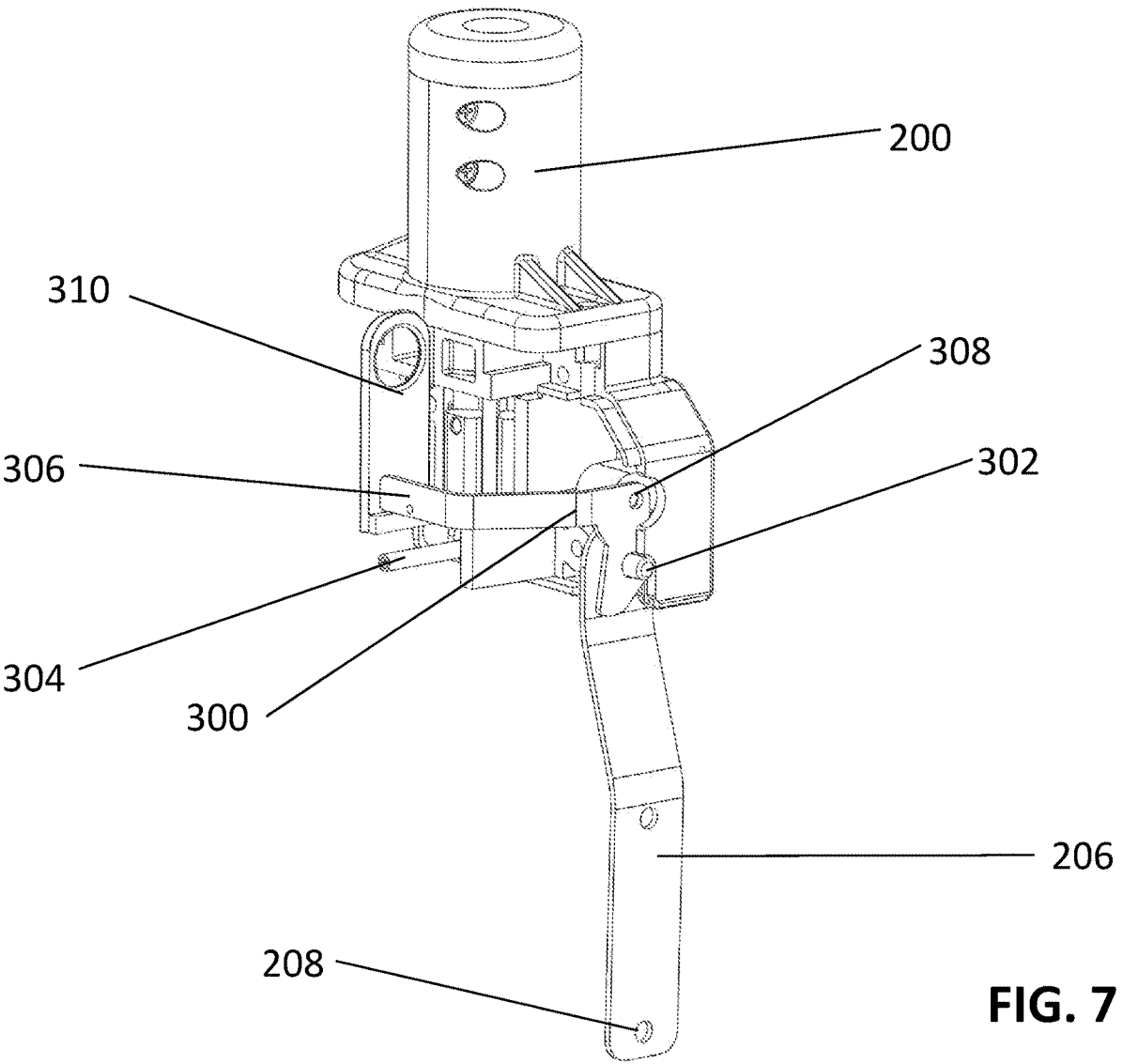
FIG. 7 shows an alternate perspective view of the locking device of the present invention having the bottom cover removed.

The safety release 310, as best shown in FIG. 7, is designed to provide a mechanism to unlatch the hook 300 from the locking member 206 from within the container 2, e.g., to be used in the event where a person is trapped inside the waste container 2. The safety release 310 is especially important when the detent mechanism is enclosed within the bottom cover 202, as a person trapped inside the container 2 cannot merely push the detent mechanism into the cavity 500 of the housing 200. The safety release 310 protrudes from the bottom cover 202 and provides a grip for the trapped person to pull. When the safety release 310 is pulled, it raises the ledge 308 which, in turn, lifts the deflecting arm 306 to unlatch the hook 300 from the locking protrusion 302. That unlatching allows the trapped person to lift the lid 4 and to free himself/herself.

Figure 5:
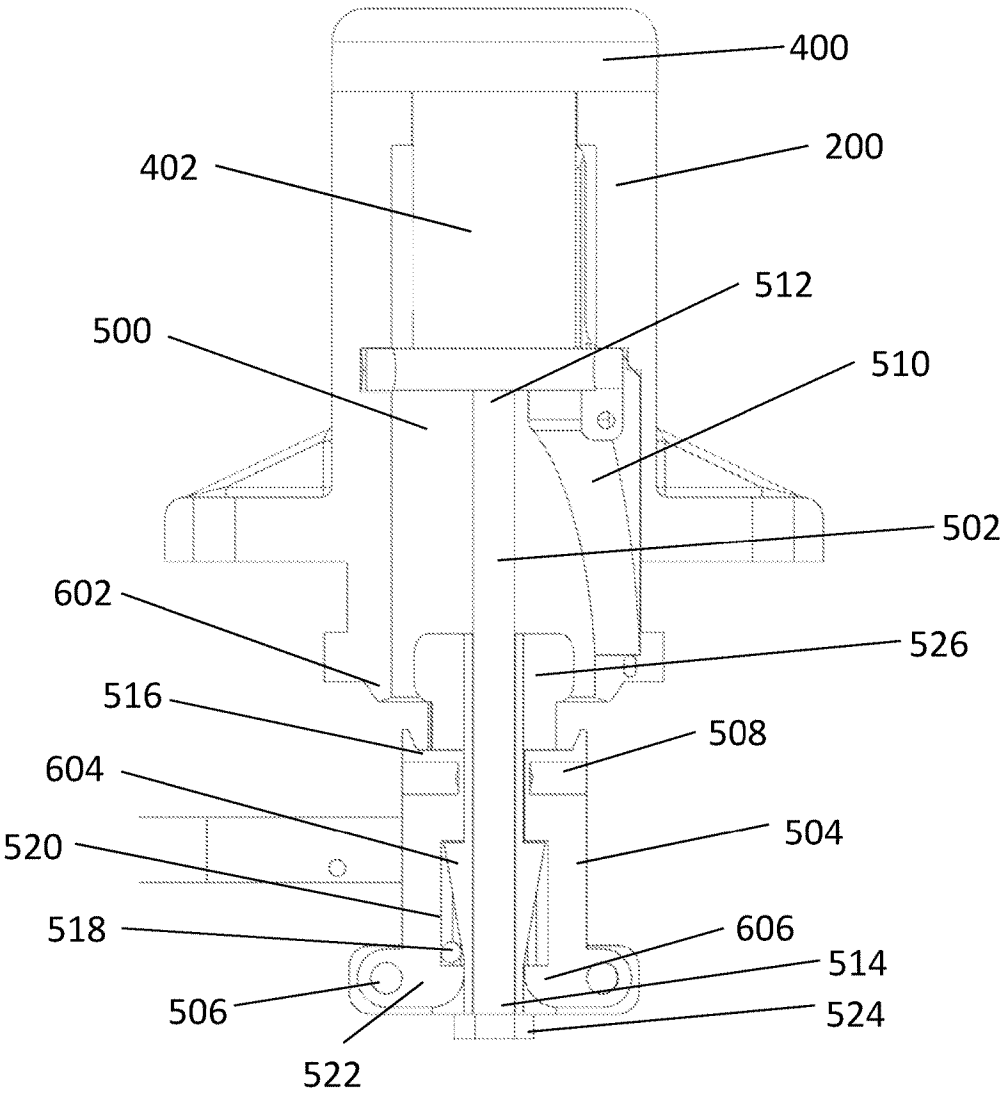
FIG. 5 shows a cross-section of the locking device of the present invention with bar segments magnetically attached to the shaft.

FIG. 3-6 shows the locking device with the bottom cover 202 removed. The housing 200 is a hollow, preferably cylindrical, object having open, opposing top and bottom ends. On top of the housing 200 sits a handle 400 that is designed to be gripped by a user and pulled upward and away from the housing 200. The handle 400 may have various shapes, as long as a user is able to obtain a sufficient grip on it to pull the handle 400 away from the housing 200. In an exemplary embodiment as illustrated in FIGS. 3 and 5, the handle 400, in a fully lowered position, sits directly on top of the housing 200 and closes the top end of the housing 200. Although the drawings depict a particular shape to the handle, one skilled in the art would understand that the handle may have different shapes and forms to perform its function as described herein.

Figure 6:
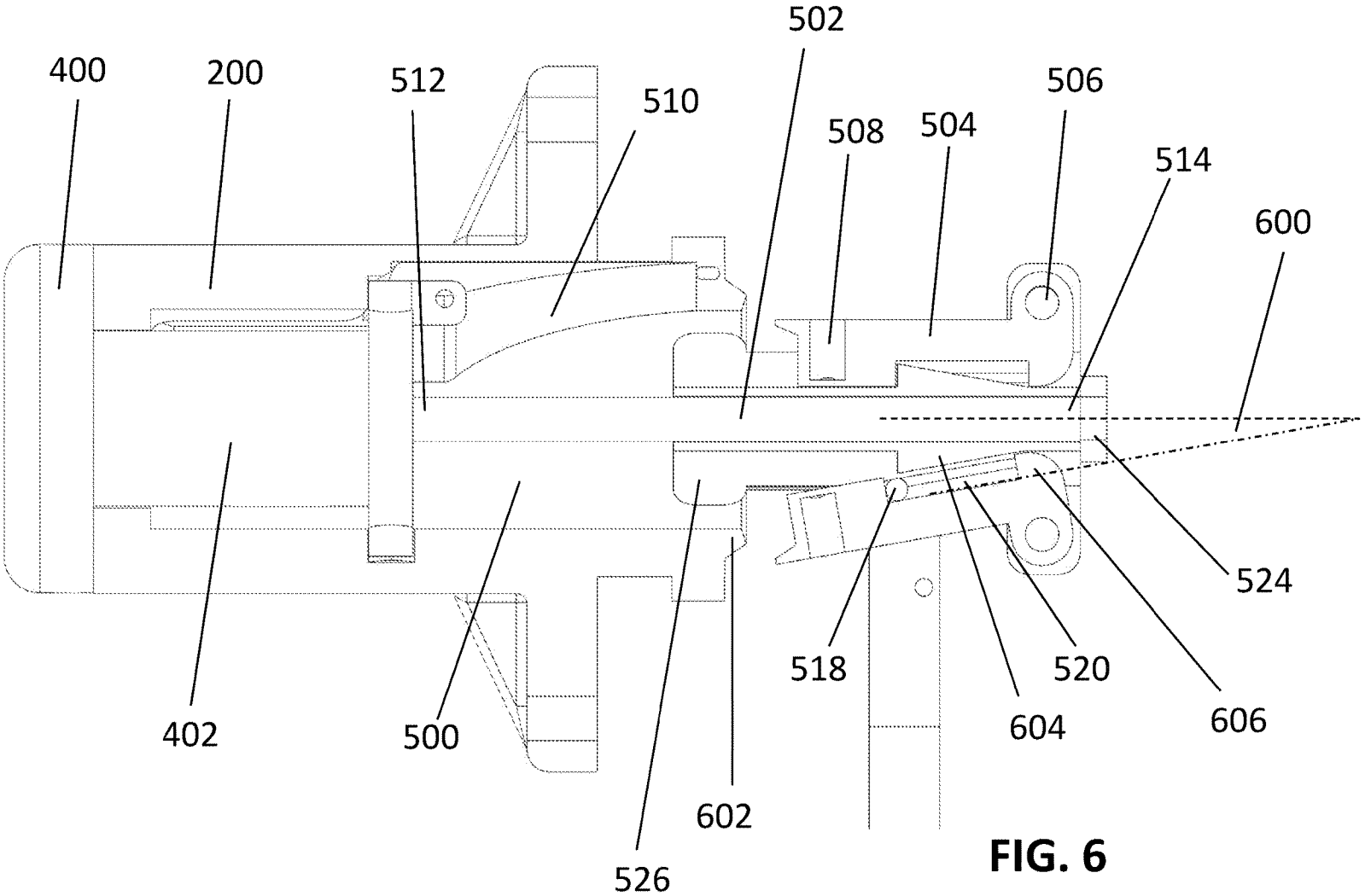
FIG. 6 shows a cross-section of the locking device of the present invention with a bar segment angularly deflected from the shaft when the locking device is over on its side.

The hollow interior of the housing 200 defines a cavity 500. As best shown in FIGS. 5-6, a shaft 502 is partially located inside the cavity 500 and extends beyond the housing 200 through the open bottom end of the housing 200. Preferably, the center axis of the shaft 502 is aligned with the center axis of the housing 200, so that the shaft 502 is centered in the cavity 500. The shaft 502 contains a top end 512 and a bottom end 514. The top end 512 resides in the cavity 500 and is connected to the handle 400. In an exemplary embodiment, as best illustrated in FIGS. 5-6, the top end 512 may be attached to the handle 400 via a piston 402 that spans the open top end of the housing 200 to stabilize the shaft during operation.

The bottom end 514 of the shaft 502 is connected to a detent mechanism containing one or more bar segments 504 disposed on the shaft, preferably equiangularly around the circumference of the shaft 502. Preferably, two or more bar segments 504 are provided, more preferably two to eight, and most preferably four. Each of the bar segments 504 has a first end 522 connected to the shaft 502, preferably at the bottom end 514, by a pivot 506. The second end 516 of the bar segment 504 is detachably connected to the shaft 502, preferably in a location closer to the housing 200 than the location of the first end 522. Thus, the bar segment 504 is in approximate parallel alignment with the shaft 502. The detachable connection of the second end 516 of the bar segment 504 to the shaft 502 is preferably by magnetic attraction. A magnet 508 may be permanently placed on the second end 516 of the bar segment 504, as best illustrated in FIGS. 5 and 6, and a ferromagnetic material is used for the shaft 502. Alternatively, the magnet may be placed on the shaft 302 and a ferromagnetic material placed on the second end 516 of the bar segment 504. A person skilled in the art would understand that various was are available to magnetically attach the second end 516 of the bar segment 504 to the shaft 502. For example, although the magnet is shown in the drawings as being located at approximately the second end 516 of the bar segment 504, the magnet 508 may be located elsewhere along the length of the bar segment 504, as long as the magnet 508 is capable of holding the second end 516 to the shaft 502. Each of the bar segments 504 preferably has the same shape as the others. The bar segments 504 are placed on a portion of the shaft 502 that is completely outside of the housing 200 when the handle 400 is in its fully lowered position (as best illustrated in FIGS. 3 and 5). In an embodiment, the second end 516 of the bar segment 504, when attached to the shaft 502, may be spaced from the bottom opening of the housing 200 by about 2 to about 20 mm, preferably about 5 to about 15 mm. The relationship between the handle 400, the shaft 502, and the bar segments 504 is such that, when the handle 400 is pulled upward and away from the housing 200, the shaft 502 moves with it and draws the bar segments 504 into the cavity 500 of the housing 200. In certain embodiments, a stop 510 may be placed in the cavity 500 of the housing 200 to prevent the bar segments from being pulled too far into the cavity 500 of the housing 200.

However, the second ends 546 of the bar segments 504, by design, may be disconnected from the shaft 502, e.g. by a force greater than the magnetic force holding them to the shaft 502, such as may occur by a jerking or jarring action (e.g., by impact with the ground) of the locking device 100. The magnetic attraction between the shaft 502 and the bar segments 504 is sufficiently strong to maintain the bar segments 504 in engagement with the shaft 502 when the locking device 100 (and thus the waste container 2) is in its natural upright position or is tilted by a lifting mechanism, but is sufficiently weak to release the bar segments 504 from the shaft 502 when the locking device is subjected to a jerking or jarring motion, such as impact with the ground. As best shown in FIG. 6, the bar segments 504 are designed so that they can only be pulled away and lay at a deflection angle 600, with respect to the axis of the shaft, of greater than 0 to about 45°, preferably about 5 to about 15°. This deflection angle allows the bar segments 504 to reattach to the shaft 502 by magnetic attraction alone when the locking device 100 is in its upright position. To keep the deflection angle within the desired limit, as best illustrated in FIGS. 5-6, the shaft 502 may be fitted with a stop ramp 604 which limits the movement of the bar segments 504 when an enlarged foot 606 of the bar segment contacts the stop ramp 604 when the bar segment 504 moves away from the shaft 502. Other methods for limiting the deflection angle may be apparent to a skilled person in the art. For example, the pivot 506 may be designed to allow only limited radial movement by the bar segments 504. When any one of the bar segments 504 is deflected from and lays at an angle to the shaft 502, the bar segments 504 cannot be pulled into a raised position sufficient for the deflecting rod 304 to raise the deflecting arm 306 to unlock the hook 300 from the locking member 206, because the deflected bar segment 504 abuts against a bottom lip 602 of the housing 200.

In an embodiment, as shown in FIGS. 5-6, each of the bar segments 504 may contain a notch 520 on the side facing the shaft 502. When the bar segment 504 is attached to the shaft 502, the notch 520 defines a cavity containing a rolling member 518 therein. The rolling member 518 may be in the form of a spherical ball. Alternatively, the rolling member 518 may be in the form of a cylindrical disc. The rolling member 518 preferably has a diameter slightly smaller than the depth of notch 520, such that the rolling member 518 can roll freely within the notch 520. As best shown in FIG. 5, when the locking device 100 is in its upright position, gravity pulls the rolling member 518 to the bottom of the notch 520. As best shown in FIG. 6, when the locking device 100 is on its side and the second end 516 of the bar segment 504 detaches and lays at a deflection angle 600 from the shaft 502, gravity palls the rolling member 518 toward the open end of the notch 520. When located at the opened end of the notch (rather than the bottom end), the rolling member 518 prevents the second end 516 from reattaching to the shaft 502 until the locking device 100 is uprighted. Although FIGS. 5-6 for illustrative purposes, only show the rolling member 518 in association with one of the bar segments 504, it should be understood that each of the bar segments 504, in a preferred embodiment, contains a rolling member 518.

In an embodiment, the bar segments 504 may be connected to the shaft 502 via a hub 526. The hub 526 surrounds and is slidable on the shaft 502. Preferably, the hub 526 is retained in slidable engagement with the shaft by a retaining nut 524. When directly connected to the hub 526, the bar segments 504 can slide into the cavity 500 of the housing 200 without the handle 400 being pulled away from the housing 200. That way, during dumping operation, the bar segments 504 can enter the cavity 500 by gravity (thus allowing the lid 4 to be opened) without the handle 400 being displaced from its lowered position. In certain embodiments, the hub 526 may be magnetically or frictionally retained on the shaft, such that the magnet or friction prevents the bar segments 504 from entering the cavity 500 of the housing 200 while the locking device 100 is in freefall. However, when the locking device 100 is tilted into an inverted position, gravity is able to overcome the magnetic or frictional force to pull the bar segments 504 into the cavity 500 of the housing 200. "Inverted position," as used herein, refers to a position where the handle 400 is lower than the bar segments 504, but not necessarily directly below the bar segments 504.

The detent mechanism may be connected to a deflecting rod 304 which extends at an angle, preferably approximately perpendicular, to the shaft 502 and/or one of the bar segments 504. As best shown in FIGS. 3-4, the deflecting rod 304 may extend from one of the pivots 506 towards deflecting arm 306 on the hook 300. The deflecting rod 304 is positioned such that when the bar segments 504 are pulled into the cavity 500 of the housing 200, the deflecting rod 304 lifts the deflecting arm 306 of the hook 300 to unlatch the hook 300 from the locking protrusion 302. Thus, in a fully lowered position, the deflecting rod 304 is located just beneath the deflecting arm 306 of the hook 300. In an exemplary embodiment, as best shown in FIG. 4, lifting of the deflecting arm 306 unlatches the hook 300 by a pivoting movement around the hole 308 on the hook 300. Although the deflecting rod 304 is shown in the drawings as being connected to one of the pivots 506, it may be connected elsewhere (e.g. directly or indirectly to the shaft) as long as it can be raised and lowered with the bar segments 504.

In use, to open the waste container 2, the user pulls upwardly on the handle 400 to a raised position, which causes the bar segments 504 to be pulled into the cavity 500 of the housing 200. That action also pulls the deflecting rod 304 upwardly toward deflecting arm 306 of the hook 300. When the deflecting rod 304 comes into contact with the deflecting arm 306, it also lifts the deflecting arm 306 upwardly to release the hook 300 from the locking protrusion 302, thus, unlocking the lid 4 and allowing the user to lift the lid 4 to open the waste container 2.

When the user closes the lid 4, gravity pulls the handle 400, shaft 502, and bar segments 504 downwardly, back to the fully lowered position, releasing the deflecting rod 304 from under the deflecting arm 306. Gravity or a spring then pulls the deflecting arm 306 downwardly to latch the hook 300 with the locking protrusion 302, thereby locking the closed lid 4.

In the event that the waste container 2 is knocked over, e.g. by strong wind or animals, the jerking or jarring action, such as by around impact, on the waste container 2 knocks at least one of the bar segments 504 (preferably the lowest locating bar segment 504 when the waste container 2 is on its side) from its magnetic attachment to the shaft 502. That action, when the waste container 2 is laid over on its side, causes angular deflection of at least one of the bar segments 504 from the shaft 502 and prevents the bar segments 504 from being accidentally pulled into the cavity 500 of the housing 200, thereby preventing release of the hook 300 from the locking protrusion 302. Accordingly, due to the angular deflection of at least one of the bar segments 504 from the shaft 502, the lid 4 cannot be opened when the waste container 2 is on its side. Also, when the waste container 2 is on its side, the rolling member(s) 518 associated with the angularly deflected bar segment(s) 504 roll to the open end(s) of the notch(es) 520 to prevent the angularly deflected bar segment(s) 504 from reattaching to the shaft 502. When the user rights the waste container 2, the rolling member(s) 518 roll to the bottom end of the notch(es) 520 to allow the magnetic attraction between the angularly deflected bar segment(s) 504 and the shaft 502 to reattach the angularly deflected bar segment(s) 504 to the shaft 502. The interaction of the shaft 502 and the bar segments 504 thus provides a mechanical sensor that can detect whether the container 2 has been unintendedly tipped over or whether it is being tipped over, such as for dumping. Because there are a plurality of bar segments 504 equiangularly disposed about shaft 502, the shaft 502 and bar segments 504 provide a mechanical sensor that detects unintended tipping of waste container 2 regardless of the direction or distance of tipping.

On the other hand, when the waste container 2 is laid on its side, e.g., by a user or an automated lifting device on a waste removal vehicle, the bar segment 504 remains magnetically attached to the shaft 502. That way, the lid can be opened by pulling on the handle 400 in a direction away from the housing 200; or when the waste container is inverted, gravity allows the lid 4 to open by pulling the bar segments 504 into the cavity 500 of the housing 200.

Due to the presence of the plurality of bar segments 504 located around the circumference of the shaft 502, the locking device 100 is able to keep the lid 4 of waste container 2 closed, when the waste container 2 falls over and impacts the ground in any direction. Furthermore, the locking device 100 is also able to keep the lid 4 closed regardless of bow far the waste container 2 falls over, as long as the impact provides sufficient jerking or jarring to dislodge at least one of the bar segments 504 from the shaft 502. On the other hand, if no impact occurs, the lid 4 can be opened when it is tipped over, such as by a lifting device on a waste removal vehicle.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. A locking device comprising a. a housing having top and bottom ends;

b. a shaft having a first end and a second end, and extending from the bottom end of the housing; and c. one or more bar segments, each bar segment having a first end and a second end, the first end of the bar segment is connected to the second end of the shaft by a pivot, the second end of the bar segment is detachably connected to the shaft, wherein, when the locking device is subjected to a jerking or jarring motion and displaced from its upright position, the second end of the bar segment is detached front the shaft.

2. The locking device of claim 1, wherein the second end of the bar segment is magnetically connected to the shaft.

3. The locking device of claim 1, wherein a plurality of bar segments are disposed equiangularly around a circumference of the shaft.

4. The locking device of claim 1, wherein two to eight bar segments are disposed equiangularly around a circumference of the shaft.

5. The locking device of claim 1, further comprising a deflecting rod connected, directly or indirectly, to the second end of the shaft at an angle therefrom.

6. The locking device of claim 1, further comprising a locking member; and a hook configured to latch to the locking member.

7. The locking device of claim 6, further comprising a bottom cover extending from the bottom end of the housing.

8. The locking device of claim 7, wherein the hook is directly attached to the bottom cover.

9. The locking device of claim 7, further comprising a safety release extending from the bottom cover for unlatching the hook from the locking member.

10. The locking device of claim 1, wherein the deflecting rod is connected to the shaft via a pivot.

11. The locking device of claim 1, wherein the bar segment, when the second end of the bar segment is detached from the shaft, forms a deflection angle of greater than 0 to about 45° with an axis of the shaft.

12. The locking device of claim 1, further comprising a handle configured to pull the bar segments toward top end of the housing.

13. The locking device of claim 12, wherein, when the handle is in a lowered position and the locking device is upright, the bar segments are completely outside of an internal cavity of the housing, and when the handle is in a raised position, the bar segments are at least partially inside the internal cavity of the housing.

14. The locking device of claim 13, wherein, when the second end of at least one bar segment is detached from the shaft, the handle cannot be placed in the raised position.

15. The locking device of claim 13, wherein, when the second end of at least one bar segment is detached from the shaft, the detached bar segment prevents the handle from being placed in the raised position.

16. The locking device of claim 1, wherein the bar segments are connected to the shaft via a hub surrounding and in slidable engagement with the shaft.

17. The locking device of claim 1, wherein the hub is magnetically or frictionally retained on the shaft.

18. A waste container comprising a main box, and a lid attached to the main box by a lid hinge, the lid comprising the locking device of claim 1 mounted therein.

19. The waste container of claim 18, wherein the locking device keeps the lid closed when the waste container falls over and impacts the ground in any direction.

20. The waste container of claim 19, wherein the locking device is mounted in a cutout in the lid.

21. The waste container of claim 20, wherein the housing is retained on the lid by a collar.

22. The waste container of claim 19, further comprising a. a locking member, the locking member is fastened to a wall of the main box; and b. a hook directly or indirectly connected to the lid and configured to latch to the locking member, the hook contains a deflecting arm extending toward the housing, wherein when the waste container is in an upright position, the deflecting arm is located above the deflecting rod.

23. The waste container of claim 22, wherein the locking device further comprising a bottom cover extending from the bottom end of the housing.

24. The waste container of claim 22, wherein, when the locking device is subjected to a jerking or jarring motion and displaced from its upright position, the second end of the bar segment is detached from the shaft.

25. The waste container of claim 21, wherein the bar segment, when the second end of the bar is detached from the shaft, forms a deflection angle of greater than 0 to about 45° with an axis of the shaft.

26. The waste container of claim 18, wherein the locking device further comprises a handle configured to pull the bar segments toward top end of the housing.

27. The waste container of claim 26, wherein, when the waste container is upright and the handle is in a lowered position, the bar segments are completely outside of the internal cavity of the housing, and when the handle is in a raised position, the bar segments are at least partially inside the internal cavity of the housing and the deflecting rod unlatches the hook from the locking member.

28. The waste container of claim 27, wherein, when the second end of the bar segment forms a deflection angle with an axis of the shaft, the handle cannot be placed in a raised position to unlatch the hook from the locking member.

29. A method for making a waste container comprising the steps of a. providing the waste container containing a main box a lid attached to the main box by a lid hinge; and b. mounting the locking device of claim 1 in a cutout of the lid, wherein the locking device keeps the lid closed when the waste container falls over and impacts the ground in any direction.

* * * * *